US008165487B2

(12) United States Patent
Kanou

(10) Patent No.: US 8,165,487 B2
(45) Date of Patent: Apr. 24, 2012

(54) SAFETY DEVICE AND FIXING DEVICE

(75) Inventor: Hirotaka Kanou, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 114 days.

(21) Appl. No.: 12/408,381

(22) Filed: Mar. 20, 2009

(65) Prior Publication Data

US 2009/0310996 A1 Dec. 17, 2009

(30) Foreign Application Priority Data

Jun. 16, 2008 (JP) ..... 2008-156320

(51) Int. Cl.
*G03G 15/20* (2006.01)

(52) U.S. Cl. ..... 399/69

(58) Field of Classification Search ..... 219/216; 399/69, 328, 330, 335, 336
See application file for complete search history.

(56) References Cited

U.S. PATENT DOCUMENTS

| | | | | |
|---|---|---|---|---|
| 5,426,495 | A | 6/1995 | Sawamura et al. | |
| 2002/0172536 | A1* | 11/2002 | Hirst et al. | 399/328 |
| 2006/0291919 | A1* | 12/2006 | Domoto et al. | 399/328 |

FOREIGN PATENT DOCUMENTS

| | | | |
|---|---|---|---|
| JP | 61-76463 | U | 5/1986 |
| JP | 07-028351 | | 1/1995 |
| JP | 2004-077683 | A | 3/2004 |
| JP | 2005-017965 | | 1/2005 |

OTHER PUBLICATIONS

Preliminary Notice of Rejection issued in the corresponding Japanese Patent Application No. 2008-156320 dated Jun. 29, 2010, and an English Translation thereof.

* cited by examiner

*Primary Examiner* — Hoang Ngo
(74) *Attorney, Agent, or Firm* — Buchanan Ingersoll & Rooney PC

(57) ABSTRACT

A fixing device has a fixing roller, a pressure roller, an electromagnetic induction heating section, a heat pipe, a temperature sensor and a control section. The fixing roller is heated by the electromagnetic induction heating section. The heat pipe is in contact with the pressure roller. The temperature sensor is in direct contact with the heat pipe to measure temperature of the heat pipe. The control section stops heating of the electromagnetic induction heating section when the temperature of the heat pipe measured by the temperature sensor reaches a preset temperature. This prevents an excessive rise in temperature of the heat pipe and suppresses an excessive increase in internal pressure of the heat pipe. Thereby, the heat pipe in the fixing device is prevented from being damaged.

10 Claims, 7 Drawing Sheets

SAFETY DEVICE AND FIXING DEVICE

CROSS-REFERENCE TO RELATED APPLICATION

This application is based on application No. 2008-156320 filed in Japan, the entire content of which is hereby incorporated by reference.

TECHNICAL FIELD

The present invention relates to a safety device and a fixing device which prevent damage to heat pipes.

BACKGROUND ART

A conventional fixing device includes a fixing roller and a heat pipe (see JP 2004-77683 A). Therein, the fixing roller is heated by a heater. Recording paper is heated and pressurized for fixing by the fixing roller and the pressure roller.

The heat pipe is in contact with the pressure roller to keep surface temperature of the pressure roller uniform. Specifically, heat is transferred into the pressure roller by evaporation or condensation of operating fluid contained in the heat pipe.

However, the conventional fixing devices has a problem that the heat pipe may be excessively heated because the heat pipe receives heat from the fixing roller via the pressure roller. This increases pressure of the operating fluid in the heat pipe and thereby causes damage to the heat pipe. That is to say, the conventional fixing devices have not been equipped with any safety devices for preventing damage to the heat pipe.

SUMMARY OF INVENTION

An object of the present invention is to provide a safety device and a fixing device capable of preventing an excessive rise of temperature in a heat pipe and suppressing increase in internal pressure of the heat pipe so as to prevent damage to the heat pipe.

In order to achieve the above-mentioned object, one aspect of the present invention provides a safety device which comprises a heat source, a heat pipe in direct or indirect contact with the heat source, a heat pipe temperature sensor for measuring temperature of the heat pipe, and a control section for stopping heat supply from the heat source to the heat pipe when the temperature of the heat pipe measured by the heat pipe temperature sensor reaches a preset temperature.

According to the safety device of the present invention, the control section stops heat supply from the heat source to the heat pipe when the temperature of the heat pipe measured by the heat pipe temperature sensor reaches a preset temperature. This makes it possible to prevent an excessive rise of temperature in the peat pipe upon reception of the heat from the heat source and to suppress increase in internal pressure of the heat pipe so as to prevent damage to the heat pipe.

Another aspect of the present invention provides a fixing device which comprises a fixing-side rotation unit and a pressure-side rotation unit which are in contact with each other so that a recording material is conveyed while toner is fixed on the recording material, a heating section for heating the fixing-side rotation unit, a heat pipe in contact with the fixing-side rotation unit or the pressure-side rotation unit, a heat pipe temperature sensor for measuring temperature of the heat pipe, and a control section for stopping heating of the heating section when the temperature of the heat pipe measured by the heat pipe temperature sensor reaches a preset temperature.

According to the fixing device in the invention, the control section stops heating of the heating section when the temperature of the heat pipe measured by the heat pipe temperature sensor reaches a preset temperature, so that heat supply from the heating section to the heat pipe via the fixing-side rotation unit is stopped. Therefore, it becomes possible to prevent the excessive rise of temperature in the peat pipe upon reception of the heat from the heating section and to suppress increase in internal pressure of the heat pipe so as to prevent damage to the heat pipe.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, embodiments of the present invention will be described in details with reference to the drawings by way of illustration.

First Embodiment

Figure 1:
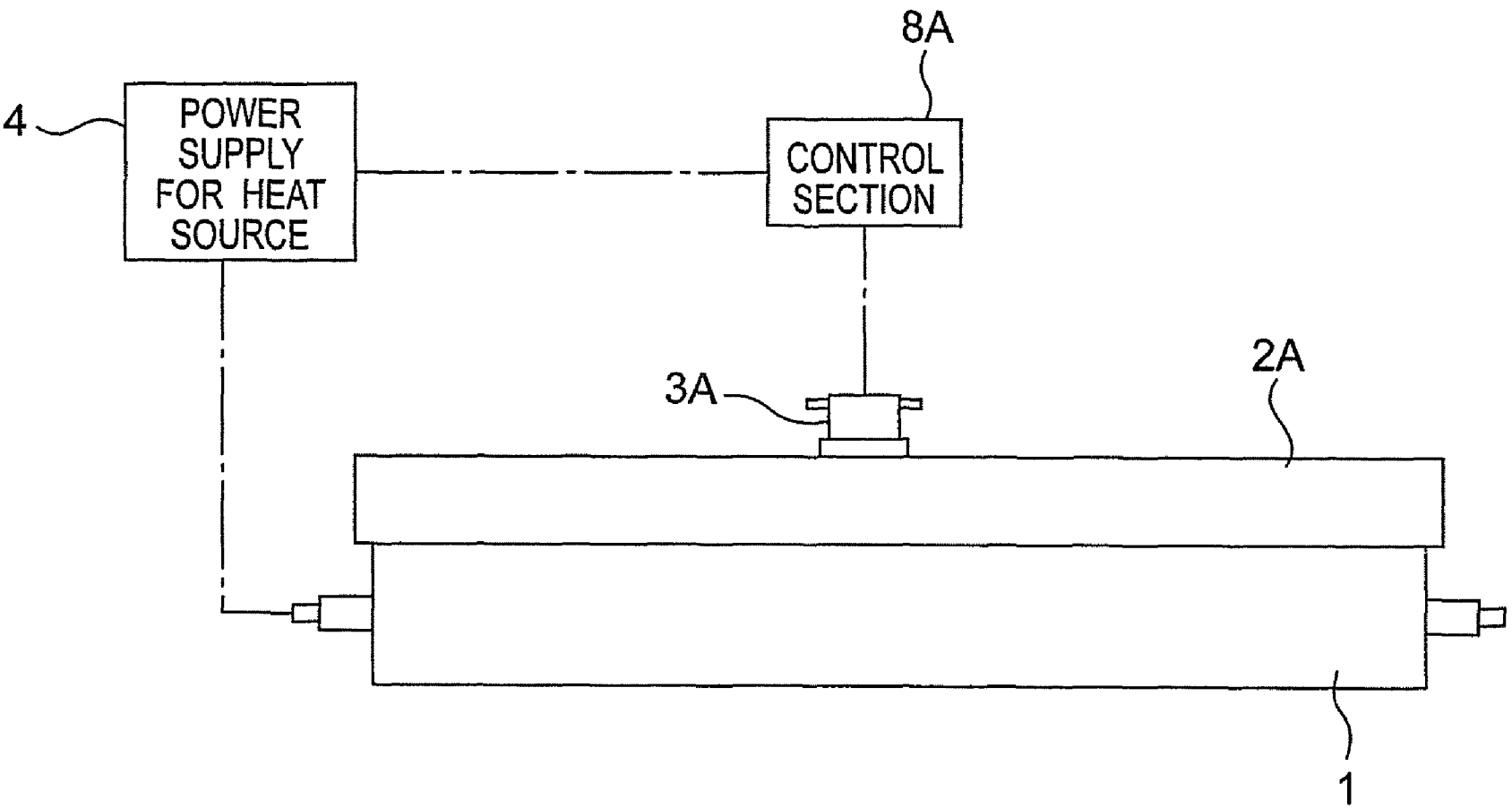
FIG. 1 shows a simplified structural view of a safety device in one embodiment of the invention.

FIG. 1 shows a simplified structural view of a safety device in a first embodiment of the present invention. As shown in FIG. 1, the safety device has a heat source 1, a heat pipe 2A, a heat pipe temperature sensor 3A and a control section 8A.

The safety device can be applied to image forming apparatuses, computers, electronic devices, semiconductors, image display devices, machine tools and so on.

The heat pipe 2A, which has a high performance in heat conduction, can be used for cooling, heating, and soaking of apparatuses. The heat pipe 2A in the image forming apparatus is used for suppressing uneven distribution of temperature in the heat source 1 and preventing an excessive rise of temperature in a non-paper feed area.

The heat pipe 2A directly contacts with the heat source 1 to cool or heat the heat source 1. Specifically, operating fluid within the heat pipe 2A is evaporated or condensed so that heat from the heat source 1 is transferred. The heat pipe 2A may be indirectly contacted with the heat source 1 via other member.

The heat pipe temperature sensor 3A directly contacts with the heat pipe 2A to measure temperature of the heat pipe 2A. The heat pipe temperature sensor 3A is a contact-type thermostat. The heat pipe temperature sensor 3A may be a non-contact-type thermistor, thermostat or thermal fuse or a non-contact-type infrared sensor.

The control section 8A stops supplying heat from the heat source 1 to the heat pipe 2A when the temperature of the heat pipe 2A measured by the heat pipe temperature sensor 3A reaches a preset temperature.

In other words, the control section 8A turns off electric power supply for the heat source 1 when the temperature of the heat pipe 2A measured by the heat pipe temperature sensor 3A reaches a preset temperature.

The preset temperature is lower than a temperature of the operating fluid at which the heat pipe 2A is damaged by vapor pressure of the operating fluid within the heat pipe 2A. Specifically, the preset temperature is 350° C. to 200° C. or less, assuming that the operating fluid in the heat pipe 2A is water, the heat pipe 2A is made of copper and thickness of the heat pipe 2A is 0.5 mm.

According to the above-structured safety device, the control section 8A stops supplying heat from the heat source 1 to the heat pipe 2A when temperature of the heat pipe 2A, which is measured by the heat pipe temperature sensor 3A, reaches a preset temperature. This makes it possible to prevent the excessive rise of temperature in the peat pipe 2A upon reception of the heat from the heat source 1, and therefore to suppress increase in internal pressure of the heat pipe 2A, so that damage to the heat pipe 2A is prevented.

Also, electric current supply for the heat source 1 can be stopped in quick response, so that heat supply from the heat source 1 to the heat pipe 2A can be quickly stopped. This is because the control section 8A turns off electric power supply for the heat source 1 when the temperature of the heat pipe 2A measured by the heat pipe temperature sensor 3A reaches a preset temperature.

Further, damage to the heat pipe 2A is surely prevented because the preset temperature is lower than the temperature of operating fluid at which the heat pipe 2A is damaged with vapor pressure of the operating fluid within the heat pipe 2A.

Second Embodiment

Figure 2:
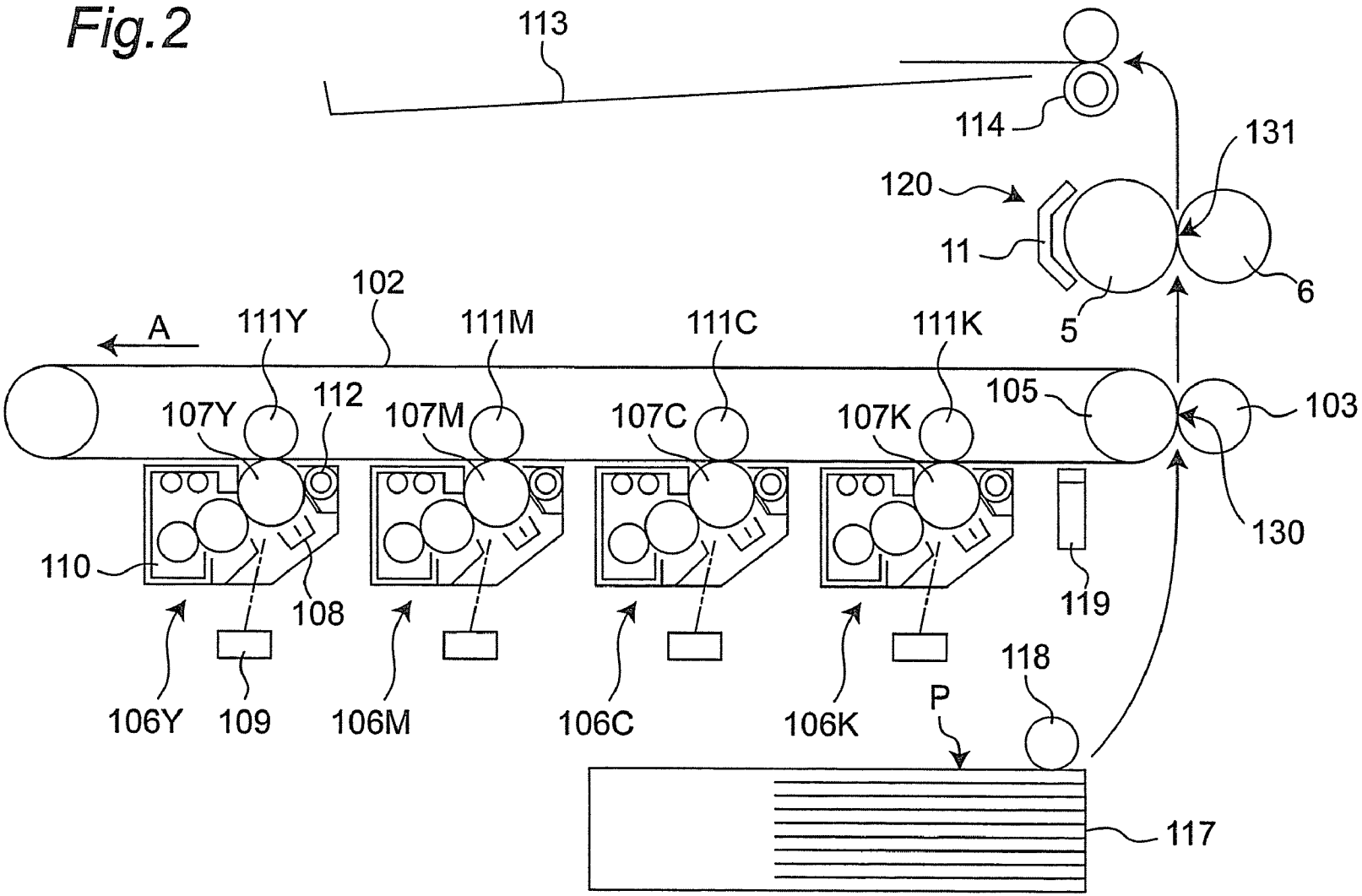
FIG. 2 shows a simplified structural view of an image forming apparatus.

In FIG. 2, which shows a simplified structural view of an image forming apparatus according to a second embodiment, the image forming apparatus is a color printer. The color printer has an intermediate transfer belt 102 as a belt member in generally the central section of the inside thereof. Four imaging units 106Y, 106M, 106C and 106K, which correspond to colors of yellow (Y), magenta (M), cyan (C) and black (K) respectively, are juxtaposed under and along the lower horizontal section of the intermediate transfer belt 102. The imaging units 106Y, 106M, 106C and 106K have photoconductor drums 107Y, 107M, 107C and 107K, respectively.

A charger 108, a print head section 109, a developing device 110, each of primary transfer rollers 111Y, 111M, 111C and 111K, and a cleaner 112 are placed in this order around each of the photoconductor drums 107Y, 107M, 107C and 107K along the rotation direction thereof. The primary transfer rollers 111Y, 111M, 111C and 111K faces the photoconductor drums 107Y, 107M, 107C and 107K respectively across the intermediate transfer belt 102.

A portion of the intermediate transfer belt 102 supported with a driving roller 105 is put in pressure contact with a secondary transfer roller 103. A nip section, which is constituted by the secondary transfer roller 103 and the intermediate transfer belt 102, forms a secondary transfer region 130.

A fixing device 120 is placed in a conveying path downstream of the secondary transfer region 130. The fixing device 120 has a fixing roller 5, a pressure roller 6 and an electromagnetic induction heating section 11. A pressure contact section between the fixing roller 5 and the pressure roller 6 serves as a fixing nip area 131.

A picture paper cassette 117 is detachably placed in a lower portion of the image forming apparatus. Paper sheets P, which are stacked and stored in the picture paper cassette 117, are sent out, sheet by sheet from top of the sheets, toward the conveying path by rotation of a feed roller 118.

An Auto Image Density Control (AIDC) sensor 119, which also serves as a resist sensor, is placed between the secondary transfer region 130 and the imaging unit 106K located most downstream of the intermediate transfer belt 102.

Description is now given on operation of the above-structured image forming apparatus.

When an image signal is inputted from an external unit (e.g., personal computer) into an image signal processing section (not shown) of the image forming apparatus, the image signal processing section immediately converts the image signal into digital image signals of yellow (Y), magenta (M), cyan (C) and black (K). Based on the inputted digital signals, print head sections 109 of the respective imaging units 106Y, 106M, 106C and 106K are made to emit light for exposure.

Accordingly, electrostatic latent images formed on each of the photoconductor drums 107Y, 107M, 107C and 107K are developed by each developing device 110, and turned into toner images of respective colors.

The toner images of respective colors are then superposed sequentially on the intermediate transfer belt 102, which moves in an arrow A direction, by the function of the primary transfer rollers 111Y, 111M, 111C and 111K, so that the toner images of respective colors are primarily transferred.

Thus, the toner images formed on the intermediate transfer belt 102 reach the secondary transfer region 130 by movement of the intermediate transfer belt 102. In the secondary transfer region 130, the superposed toner images of respective colors are secondarily transferred onto a paper sheet P in a lump by the function of the secondary transfer roller 103.

The toner images secondarily transferred onto the paper sheet P then reach the fixing nip area 131. In the fixing nip area 131, the toner images are fixed onto the paper sheet P by the function of both the fixing roller 5 induction-heated by the electromagnetic induction heating section 11 and the pressure roller 6.

The paper sheet P on which the toner images are fixed is then discharged into a paper ejection tray 113 via a paper ejecting roller 114.

Figure 3:
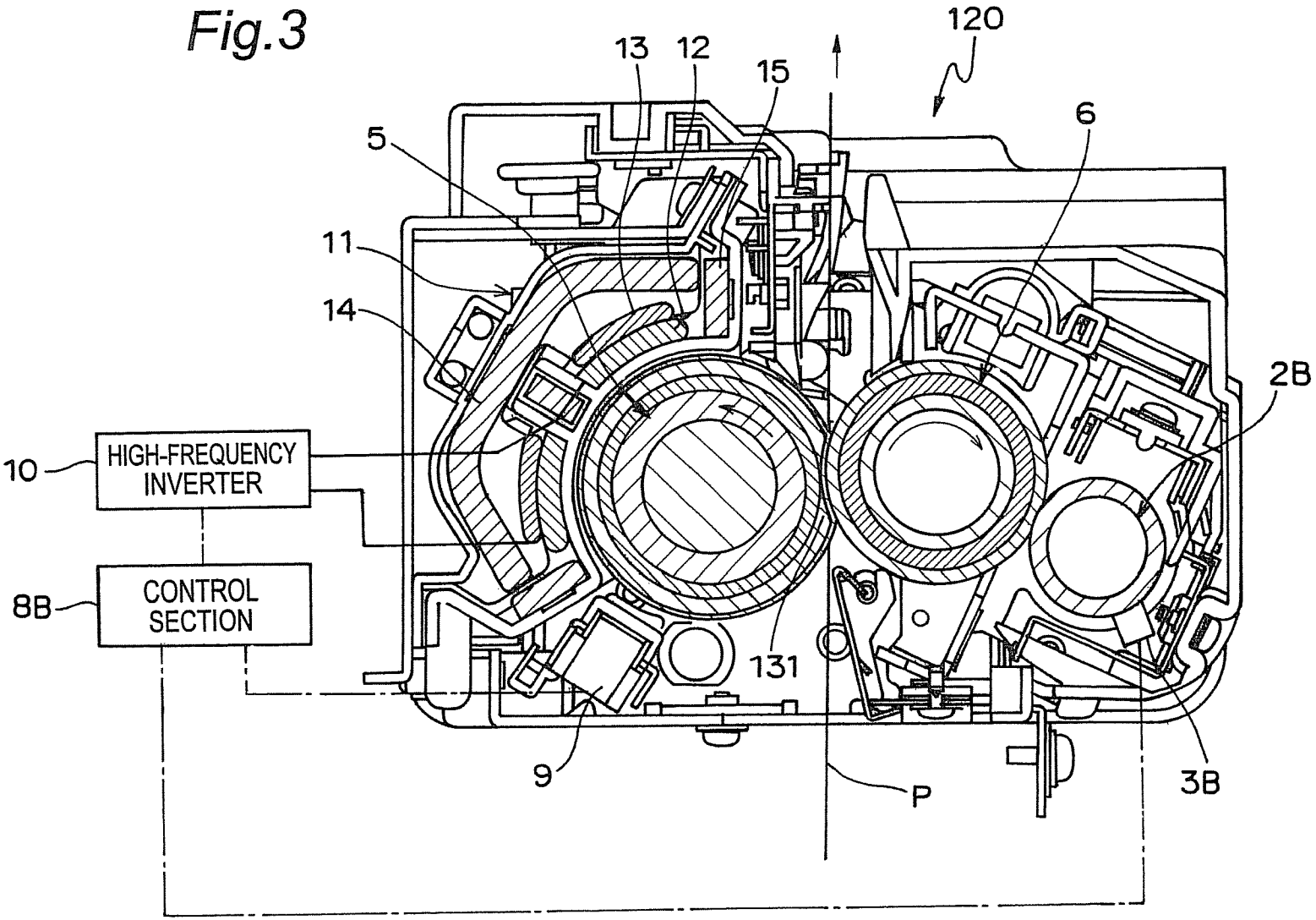
FIG. 3 shows a simplified structural view of a fixing device in one embodiment of the invention.

As shown in FIG. 3, the fixing device 120 has a fixing roller 5 as a fixing-side rotation unit, a pressure roller 6 as a pressure-side rotation unit, and an electromagnetic induction heating section 11, a heat pipe 2B, a heat pipe temperature sensor 3B and a control section 8B.

The heat pipe 2B, the heat pipe temperature sensor 3B and the control section 8B have same configurations as the heat pipe 2A, the heat pipe temperature sensor 3A and the control section 8A of the first embodiment.

The fixing roller 5 and the pressure roller 6 are contacted with each other to convey the paper sheet P as a recording material, while fixing the toner on the paper sheet P.

The fixing roller 5 is heated by the electromagnetic induction heating section 11. The pressure roller 6 is in contact with the heat pipe 2B.

The heat pipe 2B assists heat transfer between the surface of the fixing roller 5 and the surface of the pressure roller 6 so as to equalize the surface temperatures of the fixing roller 5 and the pressure roller 6.

The heat pipe 2B is in direct contact with the heat pipe temperature sensor 3B which measures the temperature of the heat pipe 2B.

The control section 8A stops heating of the electromagnetic induction heating section 11 when the temperature of the heat pipe 2B measured by the heat pipe temperature sensor 3B reaches a preset temperature.

The fixing roller 5 has a cored bar layer, a heat insulating layer, an electromagnetic induction exothermic layer, an elastic layer and a releasing layer which are placed in this order from the inside. The pressure roller 6 has a cored bar layer, a heat insulating layer and a releasing layer which are placed in this order from the inside.

The fixing roller 5, the pressure roller 6 and the heat pipe 2B are arranged in parallel with each other. Both ends of each roller are rotatably supported by unshown bearing members. The pressure roller 6 is biased toward the fixing roller 5 by an unshown pressurizing mechanism such as springs so as to form a fixing nip area 131. The heat pipe 2B is also put in pressure contact with the pressure roller 6 in a similar manner.

The pressure roller 6 is rotated clockwise as shown with an arrow at a predetermined circumferential speed by an unshown drive mechanism. The fixing roller 5 rotates following after rotation of the pressure roller 6 by frictional force due to pressure contact with the pressure roller 6 in the fixing nip area 131. The heat pipe 2B also rotates similarly by frictional force due to pressure contact of the pressure roller 6.

The surface temperature of the fixing roller 5 is detected by a fixing roller temperature sensor 9. Signals of the fixing roller temperature sensor 9 are inputted into the control section 8B. The fixing roller temperature sensor 9 is a noncontact-type infrared sensor, for example.

The control section 8B controls temperature of the fixing roller 5 based on the signal of the fixing roller temperature sensor 9. Specifically, the control section 8B automatically controls the surface temperature of the fixing roller 5 so as to keep it constant, through automatically controlling a high-frequency inverter 10 by increasing or decreasing electric power supply from the high-frequency inverter 10 to the electromagnetic induction heating section 11 based on the signal of the fixing roller temperature sensor 9.

Description is now given on fixing operation. When the pressure roller 6 is rotated, the fixing roller 5 is rotated following after rotation of the pressure roller 6. The fixing roller 5 is heated by the electromagnetic induction heating section 11. Under the state that the surface temperature of the fixing roller 5 is kept constant, a paper sheet P, which carries an unfixed toner image, is introduced into the fixing nip area 131 formed by the fixing roller 5 and the pressure roller 6. In this case, an unfixed-image-carrying surface of the paper sheet P faces the fixing roller 5.

The paper sheet P introduced into the fixing nip area 131, which is formed between the fixing roller 5 and the pressure roller 6, is movably held and conveyed by the fixing roller 5 and the pressure roller 6 while being heated by the fixing roller 5. Thereby, the unfixed toner image is melt and fixed onto the paper sheet P, and then the paper sheet P is discharged.

Figure 4:
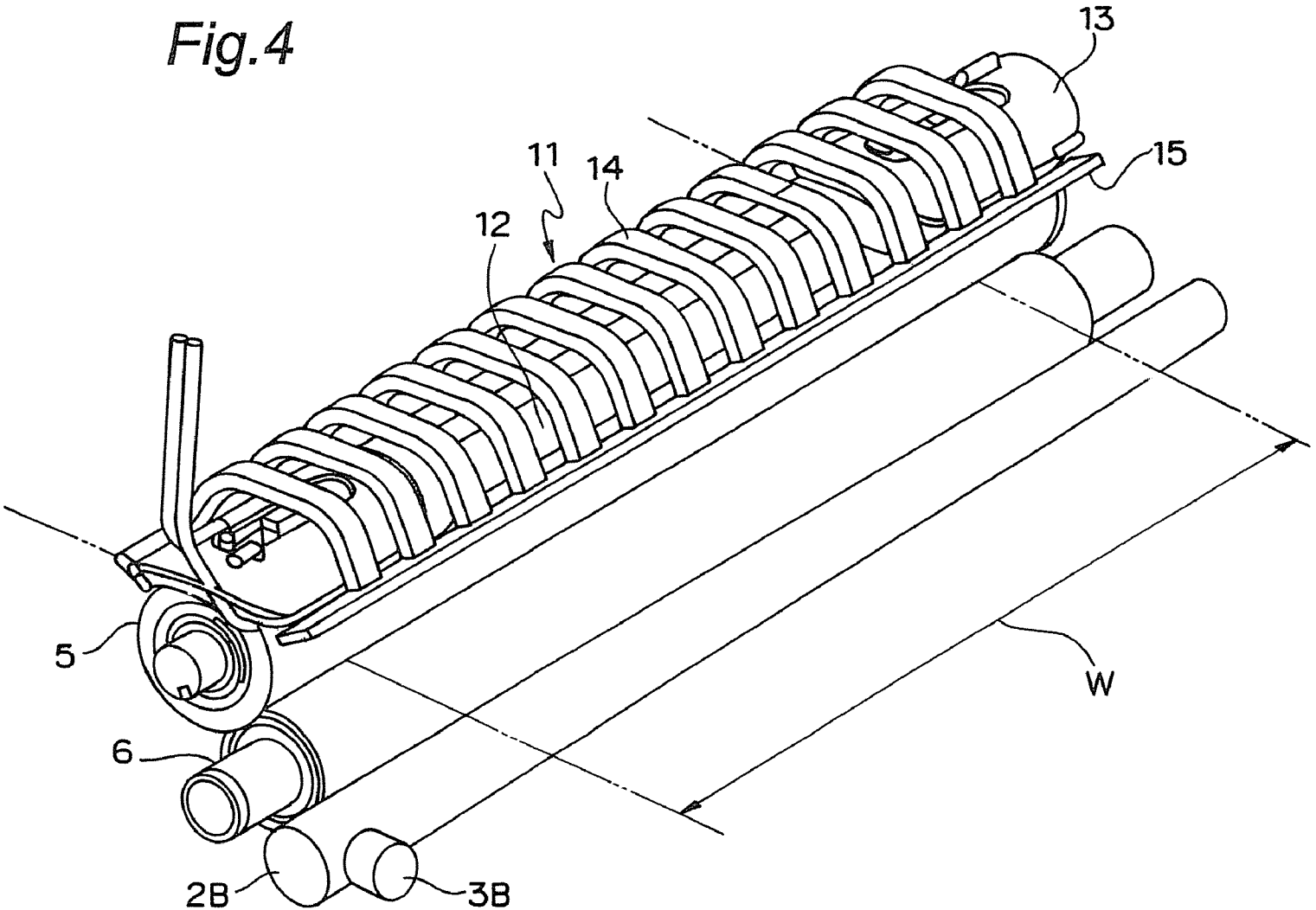
FIG. 4 shows a perspective view of the fixing device.

As shown in FIGS. 3 and 4, the electromagnetic induction heating section 11 has an exciting coil 12, a degaussing coil 13 and cores 14 and 15.

The exciting coil 12 has a structure that a lead wire is coiled along the longitudinal (axial) direction of the fixing roller 5. The exciting coil 12 is connected to the high-frequency inverter 10 so as to supply a high-frequency power of 10 to 100 kHz and 100 to 2000 W. The exciting coil 12 is formed from a litz wire composed of tens to hundreds of bundled thin wires coated with heat-resistant resin.

The degaussing coil 13 is rolled along the longitudinal direction of the exciting coil 12. The degaussing coil 13 is placed on both ends of the fixing roller 5 in the longitudinal direction thereof.

A magnetic flux is induced by the exciting coil 12. The magnetic flux passes through inside of a main core 14 and an edge core 15 so as to travel through the electromagnetic induction exothermic layer of the fixing roller 5. Thereby, an eddy current is induced in the electromagnetic induction exothermic layer, so that Joule heat is generated.

The exciting coil 12 and the degaussing coil 13 are connected to the control section 8B for the high-frequency inverter 10 which has a change switch.

When large-size paper sheets P are fed, only the exciting coil 12 is operated while the degaussing coil 13 does not function as a coil.

When smaller-size paper sheets than a prescribed size are fed, the degaussing coil 13 is also operated to generate a magnetic field in the direction of disturbing the magnetic field of the exciting coil 12, so as to achieve a demagnetization effect.

As a result, the power of the magnetic field generated from the exciting coil 12 is decreased only in an area where the degaussing coil 13 is present. Accordingly, the heat value of the fixing roller 15 is decreased only in the range where the degaussing coil 13 exists. In other words, placement of the degaussing coil 13 makes it possible to reduce an excessive rise of temperature in the non-paper feed area (i.e. rise of the temperature around the ends of the fixing roller 5) at the time of feeding the small-size paper sheets P.

The electromagnetic induction exothermic layer of the fixing roller 5 has low heat capacity. Thus, heat transfer is extremely small in the axial direction of the fixing roller 5, which deteriorates quality of the fixed image during feed of large-size paper sheets. This makes it difficult to achieve a high speed performance, a high quality in fixed images and prevention of temperature rise in the non-paper feed area.

In particular, the temperature rise in the non-paper feed area is attributed to heat generated by a magnetic flux which reaches outside of the paper sheet width. Thus, using only the degaussing coil 13 makes it difficult to achieve a high speed performance, a high quality in fixed images and prevention of the excessive temperature rise in the non-paper feed area while accommodating various width-sized paper sheets.

In the case of a single degaussing coil, when the small-size paper sheets are supplied ahead of middle-size paper sheets, temperature of the non-paper feed area is suppressed to be below the upper limit temperature of heat-resistant. Thereby, when middle-size paper sheets are supplied, an area at a temperature less than the lower limit for fixing is generated in the paper feed area of the middle-size paper sheets. This leads to deterioration of the fixed image quality. On the other hand, in the case of the single degaussing coil, when the larger-size paper sheets are supplied ahead of the small-size paper sheets, it becomes impossible to suppress the temperature in the non-paper feed area of the small-size paper sheets below the upper limit temperature of heat-resistant.

The fixing device of this embodiment has the heat pipe 2B. The heat pipe 2B makes it possible to equalize the surface temperatures of the fixing roller 5 and the pressure roller 6, so that the excessive rise of temperature is suppressed in the non-paper feed area. The heat pipe 2B is a roller with built-in a copper pipe containing operating fluid, or a steel pipe containing operating fluid, for example. The heat pipe has a lateral-directional heat transfer capability several dozen times of that of conventional aluminum rollers.

An axial length of the heat pipe 2B is larger than a maximum paper feed width W, that is to say, a passage width of maximum-size paper sheets P which pass through between the fixing roller 5 and the pressure rollers 6. A heat pipe temperature sensor 3B is in contact with a portion of the heat pipe 2B which is located outside the maximum paper feed width W.

The control section 8B stops heating of the electromagnetic induction heating section 11 when temperature of the heat pipe 2B measured by the heat pipe temperature sensor 3B reaches a prescribed temperature. The prescribed temperature is lower than the temperature of operating fluid at which the heat pipe 2B is damaged by vapor pressure of the operating fluid within the heat pipe 2B.

According to the above-structured fixing device, heat supply from the electromagnetic induction heating section 11 to the heat pipe 2B via the fixing roller 5 is stopped because the control section 8A stops heating of the electromagnetic induction heating section 11 when the temperature of the heat pipe 2B measured by the heat pipe temperature sensor 3B reaches a preset temperature. This makes it possible to prevent the excessive rise of temperature in the peat pipe 2B upon reception of the heat from the electromagnetic induction heating section 11 and to suppress increase in internal pressure of the heat pipe 2B so as to prevent damage to the heat pipe 2B.

The heat pipe temperature sensor 3B is in contact with a portion of the heat pipe 2B which is located outside the maximum paper feed width W. Therefore, the temperature of the heat pipe 2B can be measured with sufficient response. It also becomes possible to prevent a mark of contact with the heat pipe temperature sensor 3B from being printed on the paper sheet P after the mark is transferred onto the fixing roller 5 or the pressure roller 6.

Specifically, the fixing device has a temperature difference of only several dozen degrees centigrade between temperature required for fixing toner onto the paper sheet P and failure temperature of the heat pipe 2B. Therefore, the fixing device requires high response to temperature. However, the response to temperature is enhanced by the heat pipe temperature sensor 3B directly contacting with the heat pipe 2B. Temperature detection accuracy in the temperature sensor 3B may sufficiently be acquired even if the temperature sensor 3B is placed at the end of the heat pipe 2B since the heat pipe 2B has sufficient heat transfer performance.

Third Embodiment

Figure 5:
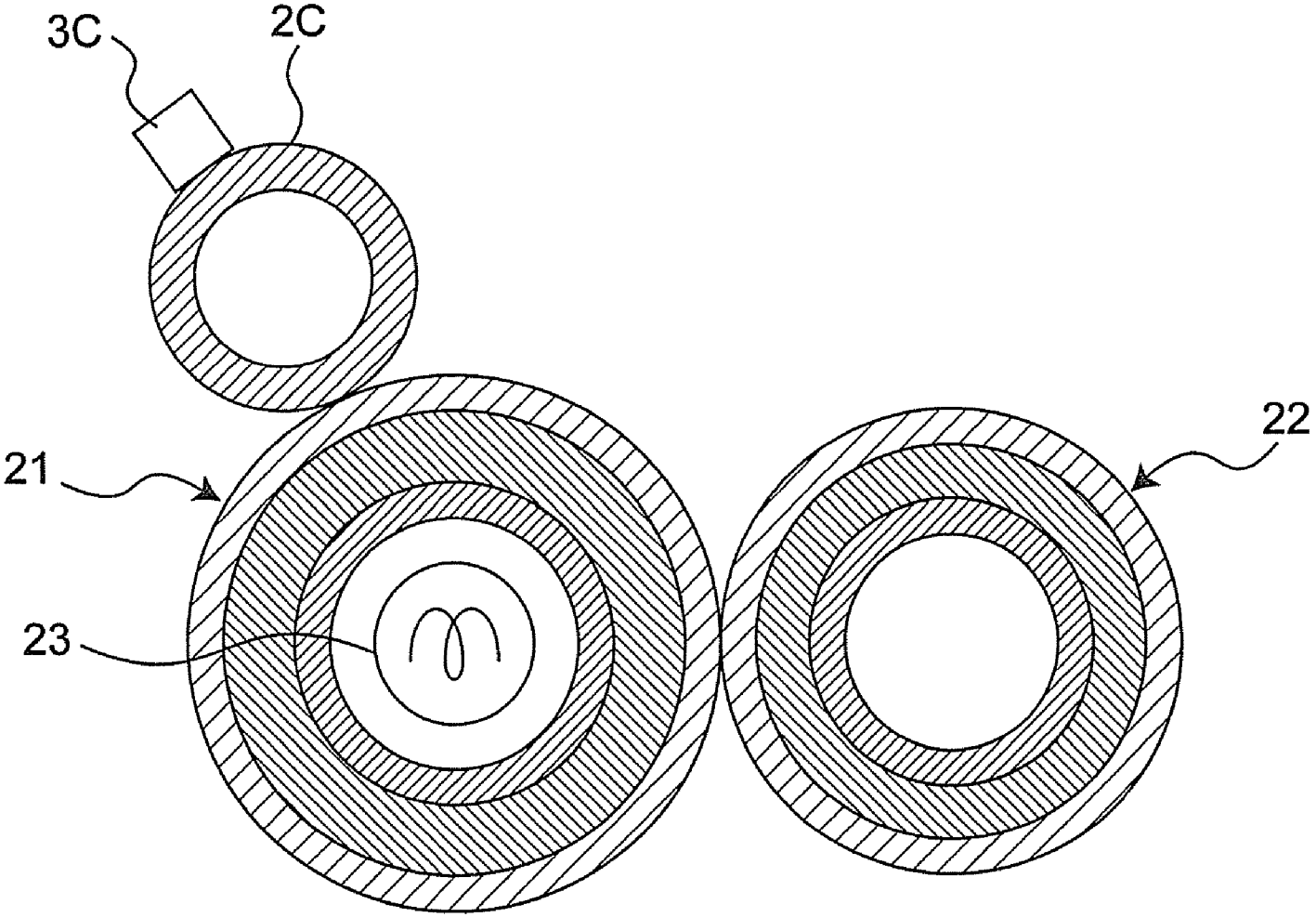
FIG. 5 shows a simplified structural view of a fixing device in another embodiment of the invention.

FIG. 5 shows a fixing device in another embodiment of the invention. The second embodiment is different from the first embodiment (FIG. 3) in the structure of the heating section and the position of the heat pipe. Other structures than the above are identical to those in the second embodiment, and therefore the description thereof is omitted.

A fixing roller 21 serving as a fixing-side rotation unit is heated by a heater 23 serving as a heating section. The heater 23 is a halogen heater, for example. The heater 23 is placed inside the fixing roller 21. The fixing roller 21 has a cored bar layer, an elastic layer and a releasing layer which are placed in this order from the inside.

A heat pipe 2C is in direct contact with the fixing roller 21 instead of a pressure roller 22 serving as a pressure-side rotation unit. A heat pipe temperature sensor 3C is in direct contact with the heat pipe 2C to measure temperature of the heat pipe 2C.

The pressure roller 22, the heat pipe 2C and the heat pipe temperature sensor 3C have configurations equivalent to those of the pressure roller 6, the heat pipe 2B and the heat pipe temperature sensor 3B in the second embodiment (FIG. 3).

According to the fixing device of this configuration, the heat pipe temperature sensor 3C can detect the temperature of the fixing roller 21 via the heat pipe 2C even when rotation of the fixing roller 21 is at stop. Therefore, the fixing roller 21 is not heated beyond a certain limit by the heater 23. In other words, the heat pipe temperature sensor 3C functions as a fuse of the heater 23.

Fourth Embodiment

Figure 6:
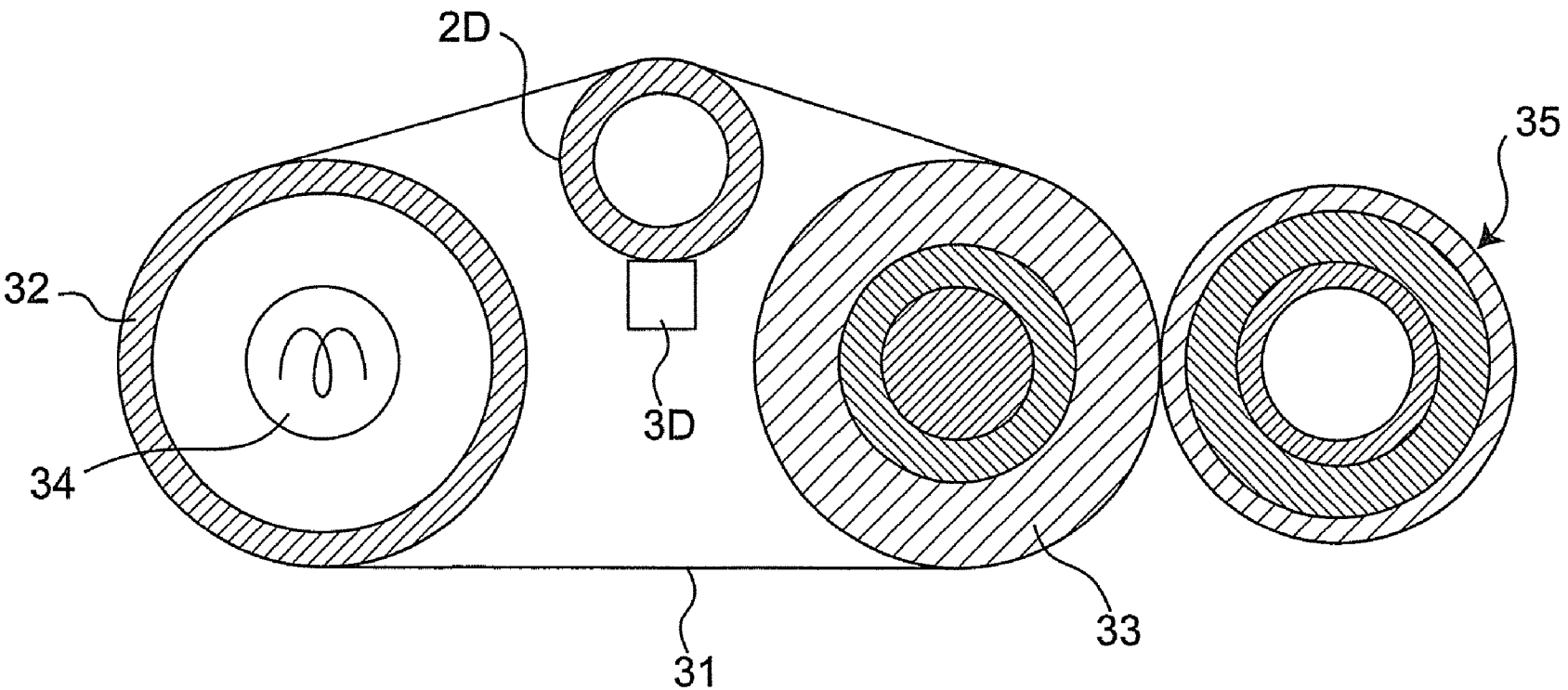
FIG. 6 shows a simplified structural view of a fixing device in still another embodiment of the invention.

FIG. 6 shows a fixing device in another embodiment of the invention. The fourth embodiment is different from the first embodiment (FIG. 3) in the structure of the fixing-side rotation unit, the structure of the heating section and the position of the heat pipe. Other structures than the above are identical to those in the second embodiment, and therefore the description thereof is omitted.

A fixing belt 31 serving as a fixing-side rotation unit is stretched over a heating roller 32 and a driving roller 33. The fixing belt 31 rotates by rotation of the driving roller 33.

The fixing belt 31 is heated by a heater 34 serving as a heating section. The heater 34 is a halogen heater, for example. The heater 34 is placed inside the heating roller 32. The heater 34 heats the fixing belt 31 via the heating roller 32.

A heat pipe 2D is in direct contact with the inner surface of the fixing belt 31 instead of a pressure roller 35 serving as a pressure-side rotation unit. A heat pipe temperature sensor 3D is in direct contact with the heat pipe 2D to measure temperature of the heat pipe 2D.

The pressure roller 35, the heat pipe 2D and the heat pipe temperature sensor 3D have configurations equivalent to those of the pressure roller 6, the heat pipe 2B and the heat pipe temperature sensor 3B in the second embodiment (FIG. 3).

According to the fixing device having this configuration, the heat pipe 2D is placed inside the fixing belt 31. This can prevent a contact mark of the sensor 3D on images and allows free placement of the sensor 3D on the heat pipe 2D.

Fifth Embodiment

Figure 7:
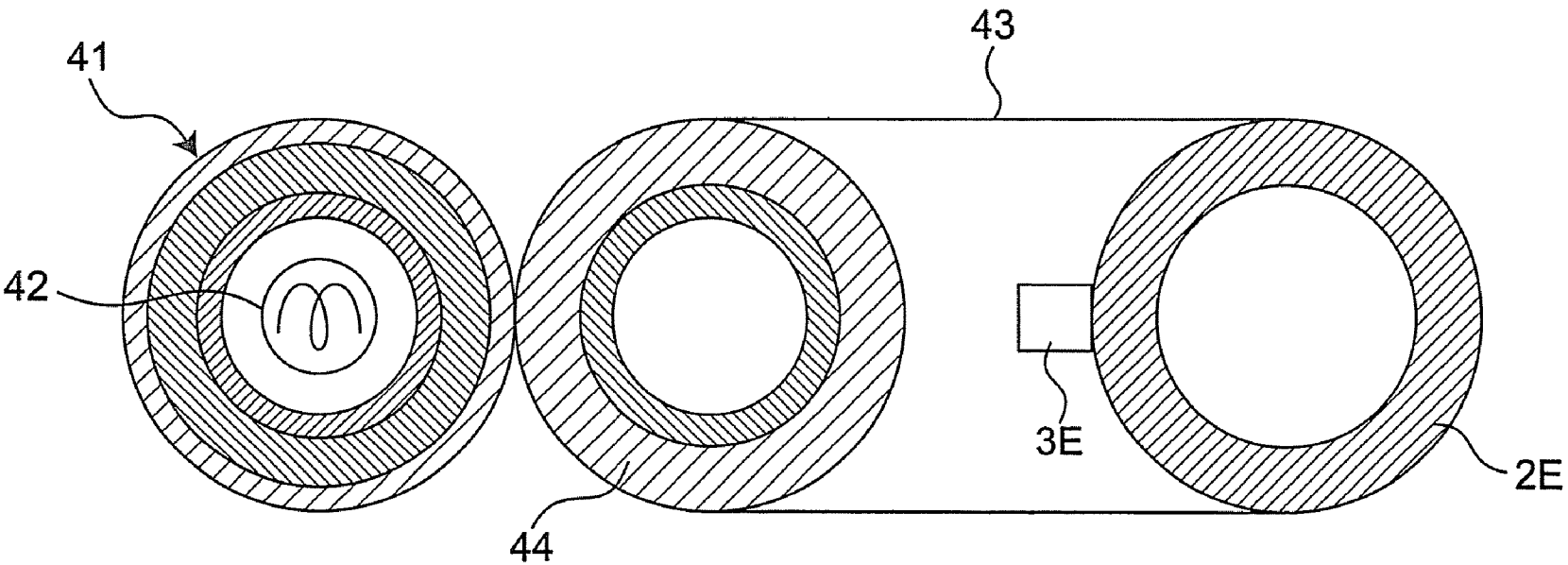
FIG. 7 shows a simplified structural view of a fixing device in yet another embodiment of the invention.

FIG. 7 shows a fixing device in yet another embodiment of the invention. The fifth embodiment is different from the second embodiment (FIG. 3) in the structure of the pressure-side rotation unit, the structure of the heating section and the position of the heat pipe.

Other structures than the above are identical to those in the second embodiment, and therefore the description thereof is omitted.

A fixing roller 41 serving as a fixing-side rotation unit is heated by a heater 42 serving as a heating section. The heater 42 is a halogen heater, for example. The heater 42 is placed inside the fixing roller 41. The fixing roller 41 has a cored bar layer, an elastic layer and a releasing layer which are placed in this order from the inside.

A pressure belt 43 serving as a pressure-side rotation unit is stretched over a heat pipe 2E and a driving roller 44. The heat pipe 2E is in contact with the inner surface of the pressure belt 43. The pressure belt 43 rotates by rotation of the driving roller 44.

A heat pipe temperature sensor 3E is in direct contact with the heat pipe 2E to measure temperature of the heat pipe 2E.

The heat pipe 2E and the heat pipe temperature sensor 3E have configurations equivalent to those of the heat pipe 2B and the heat pipe temperature sensor 3B in the second embodiment (FIG. 3).

According to the fixing device having this configuration, the heat pipe 2E is placed inside the pressure belt 43. This can prevent a contact mark of the sensor 3E on images and allows free placement of the sensor 3E on the heat pipe 2E.

The present invention shall not be limited to the above-disclosed embodiments. For example, the image forming apparatus may be any other apparatus including monochrome/collar copying machines, printers, facsimiles, and multi-functional machines having these functions.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

REFERENCE SIGNS LIST

1 Heat source
2 Heat pipe
3 Heat pipe temperature sensor
4 Electric power supply for heat source
5 Fixing roller (Fixing-side rotation unit)
6 Pressure roller (Pressure-side rotation unit)
8A, 8B Control section
9 Fixing roller temperature sensor
10 High-frequency inverter
11 Electromagnetic induction heating section
12 Exciting coil
13 Degaussing coil
14 Main core
15 Edge core
21 Fixing roller (Fixing-side rotation unit)
22 Pressure roller (Pressure-side rotation unit)
23 Heater (Heating section)
31 Fixing belt (Fixing-side rotation unit)
32 Heating roller
33 Driving roller
34 Heater (Heating section)
35 Pressure roller (Pressure-side rotation unit)
41 Fixing roller (Fixing-side rotation unit)
42 Heater (Heating section)
43 Pressure belt (Pressure-side rotation unit)
44 Driving roller

CITATION LIST

Patent Literature

Reference 1: JP 2004-77683 A

The invention claimed is:

1. A safety device comprising:
a heat source;
a heat pipe in direct or indirect contact with the heat source;
a heat pipe temperature sensor for measuring temperature of the heat pipe; and
a control section for stopping heat supply from the heat source to the heat pipe when the temperature of the heat pipe measured by the heat pipe temperature sensor reaches a preset temperature,
wherein the heat pipe contains operating fluid for transferring heat by evaporation or condensation.

2. The safety device set forth in claim 1, wherein
the heat pipe temperature sensor is a contact-type thermostat.

3. The safety device set forth in claim 1, wherein
the control section turns off power supply which supplies electric current to the heat source when the temperature of the heat pipe measured by the heat pipe temperature sensor reaches the preset temperature.

4. A fixing device comprising:
a fixing-side rotation unit and a pressure-side rotation unit which are in contact with each other so that a recording material is conveyed while toner is fixed on the recording material;
a heating section for heating the fixing-side rotation unit;
a heat pipe in contact with the fixing-side rotation unit or the pressure-side rotation unit;
a heat pipe temperature sensor for measuring temperature of the heat pipe; and
a control section for stopping heating of the heating section when the temperature of the heat pipe measured by the heat pipe temperature sensor reaches a preset temperature,
wherein the heat pipe contains operating fluid for transferring heat by evaporation or condensation.

5. The fixing device set forth in claim 4, wherein
an axial length of the heat pipe is larger than a passage width of a maximum-size recording material passing through between the fixing-side rotation unit and the pressure-side rotation unit, and
the heat pipe temperature sensor is in contact with a portion of the heat pipe which corresponds to an outside of the passage width of the maximum-size recording material.

6. The fixing device set forth in claim 4, wherein
the preset temperature is lower than a temperature of operating fluid at which the heat pipe is damaged by a vapor pressure of the operating fluid in the heat pipe.

7. A fixing device comprising:
a first rotation unit rotatably held;
a heating section for heating the first rotation unit;
a second rotation unit placed in pressure contact with the first rotation unit, wherein a paper sheet carrying toner passes through a nip section formed between the first rotation unit and the second rotation unit, whereby the toner is fixed on the paper sheet;
a heat pipe in rotatable contact with the second rotation unit;
a temperature sensor for measuring temperature of the heat pipe; and
a control section for stopping heating of the heating section when the temperature of the heat pipe measured by the temperature sensor exceeds a prescribed temperature,
wherein the heat pipe contains operating fluid for transferring heat by evaporation or condensation.

8. The fixing device set forth in claim 7, wherein
the temperature sensor is placed in contact with the heat pipe.

9. The fixing device set forth in claim 7, wherein
the temperature sensor is placed in contact with a portion of the heat pipe which corresponds to an outside of a maximum width of the paper sheet.

10. The fixing device set forth in claim 7, wherein
the first rotation unit includes an electromagnetic induction exothermic layer, and
the heating section has an exciting coil for generating heat in the electromagnetic induction exothermic layer.

* * * * *